US007040010B2

(12) United States Patent
Bouman

(10) Patent No.: US 7,040,010 B2
(45) Date of Patent: May 9, 2006

(54) AUTOFEED SPEED RIVET TOOL

(75) Inventor: Wim Bouman, Toronto (CA)

(73) Assignee: Textron Inc., Providence, RI (US)

( * ) Notice: Subject to any disclaimer, the term of this patent is extended or adjusted under 35 U.S.C. 154(b) by 0 days.

(21) Appl. No.: 11/114,707

(22) Filed: Apr. 26, 2005

(65) Prior Publication Data

US 2005/0241145 A1 Nov. 3, 2005

Related U.S. Application Data

(60) Provisional application No. 60/566,777, filed on Apr. 30, 2004.

(51) Int. Cl.

| | |
|---|---|
| ***B21J 15/28*** | (2006.01) |
| ***B21P 9/05*** | (2006.01) |
| ***B23P 11/00*** | (2006.01) |
| ***B21D 9/05*** | (2006.01) |

(52) U.S. Cl. ..... 29/812.5; 29/243.53; 72/391.6

(58) Field of Classification Search ..... 29/812.5, 29/243.53, 243.523, 243.525; 72/391.6, 72/391.4

See application file for complete search history.

(56) References Cited

U.S. PATENT DOCUMENTS

| | | | | |
|---|---|---|---|---|
| 4,027,520 | A * | 6/1977 | Klein | 29/812.5 |
| 4,628,722 | A * | 12/1986 | Mauer et al. | 29/812.5 |
| 4,643,344 | A * | 2/1987 | Kaita et al. | 72/391.6 |
| 5,035,353 | A * | 7/1991 | Smart et al. | 29/243.523 |
| 5,042,131 | A * | 8/1991 | Low | 72/391.6 |
| 5,104,024 | A * | 4/1992 | Brewer et al. | 72/391.6 |
| 5,390,524 | A * | 2/1995 | Higgs | 72/391.6 |
| 6,079,604 | A | 6/2000 | Banducci et al. | |
| 6,125,680 | A | 10/2000 | Bradbury et al. | |
| 6,240,613 | B1 | 6/2001 | O'Connor et al. | |
| 6,256,854 | B1 | 7/2001 | Chitty et al. | |
| 6,347,449 | B1 | 2/2002 | Calkins et al. | |
| 6,637,099 | B1 | 10/2003 | Seewraj | |

FOREIGN PATENT DOCUMENTS

| | | |
|---|---|---|
| GB | 2 124 955 A | 2/1984 |

* cited by examiner

*Primary Examiner*—David Jones
(74) *Attorney, Agent, or Firm*—Trexler, Bushnell, Giangiorgi, Blackstone & Marr, Ltd.

(57) ABSTRACT

An autofeed speed rivet tool and method which does not require a mandrel to be constantly withdrawn and re-stocked, is very efficient and can be used in a flow line application without requiring the line to be stopped to re-load the tool with rivets. A flexible tube carries rivets to a tool, along a guide wire. A flexible, inner tube may carry the rivets, and nylon balls may be provided on an outer tube where the nylon balls work as joints, and allow the outer tube to compress without shortening the center line. The tool may incorporate a plurality of inventive concepts, such as spoons with pivotable blades which grip the mandrel very much forward of the end of the mandrel, a transfer mechanism, rivet centering mechanisms and a mechanism for longitudinally managing the mandrel.

36 Claims, 14 Drawing Sheets

AUTOFEED SPEED RIVET TOOL

RELATED APPLICATION (PRIORITY CLAIM)

This application claims the benefit of U.S. Provisional Application Ser. No. 60/566,777, filed Apr. 30, 2004.

BACKGROUND OF THE INVENTION

The present invention generally relates to tools and methods for installing rivets, and more specifically relates to an autofeed speed rivet tool, such as an autofeed speed rivet tool for use in medium-sized applications (i.e., between 1 and 5 million rivets a year), and a method of installing a rivet using an autofeed speed rivet tool.

While there are small, autofeed rivet tools for handling small operations and expensive, console-type rivet tools for handling large operations, there is not a widely available rivet tool which can be taken to a site to handle medium-sized operations.

Prior art hand tools have employed mandrels which hold maybe 35 rivets. After firing the 35 rivets, the mandrel must be re-stocked with rivets. This requires the mandrel to be withdrawn from the tool, and a new chain of rivets (initially provided adhered to a peel-away piece of paper) to be installed on the mandrel. This requires both time and dexterity. Mandrels typically last about 30,000 cycles. The present invention is directed to a hand tool which does not require the mandrel to be constantly withdrawn and re-stocked every 35 rivets or so. This allows a robot to use the tool, if desired, and allows the tool to be used in a flow line application (i.e., assembly line) without requiring the line to be stopped to re-load the tool with rivets. Providing that the tool is constantly fed rivets may result in an increase in efficiency of 50 to 80%.

OBJECTS AND SUMMARY

An object of an embodiment of the present invention is to provide an autofeed speed rivet tool and method for medium-sized applications.

Another object of an embodiment of the present invention is to provide a hand tool and method which does not require the mandrel to be constantly withdrawn and re-stocked.

Still another object of an embodiment of the present invention is to provide a hand tool and method which can be used in a flow line application (i.e., assembly line) without requiring the line to be stopped to re-load the tool with rivets.

Still yet another object of an embodiment of the present invention is to provide an autofeed speed rivet tool and method which is very efficient.

Briefly, and in accordance with the foregoing, several embodiments of the present invention are disclosed herein. One embodiment of the present invention provides that a flexible tube carries rivets to a tool. Preferably, the rivets are carried along a guide wire. The guide wire may or may not be welded to a mandrel in the tool. Preferably, a guide wire is employed and the rivets are blown through the tube using air.

Another embodiment of the present invention provides that a flexible, inner tube carries rivets along a guide wire to a tool, and nylon balls are provided every inch or so along an outer tube which may be made of aluminum. The nylon balls work as joints, and allow the outer tube to compress without shortening the center line.

Another embodiment of the present invention provides that spoons are used to allow the passage of a single rivet to a chain of rivets upstream from the spoons, thereafter grip the mandrel during broaching of the front-most rivet in the chain, and apply a force to the back-most rivet in the chain so the second rivet in the chain pushes the nose of the tool open to position the second rivet in the chain outside the tool for subsequent broaching. The spoons may or may not be configured such that they open and close during the process. In addition to employing spoons, staggered pairs of balls and a slidable collar can be used to provide a gate. Such a gate may be employed if it is desired to store rivets in the tube, upstream from the tool. The gate preferably provides that only one rivet a time is allowed to advance past the spoons in the tool.

A preferred embodiment of the present invention may incorporate a plurality of additional inventive concepts, such as a transfer mechanism, rivet centering mechanisms, a mechanism for longitudinally managing the mandrel, and a mechanism for gripping the mandrel very much forward of the end of the mandrel, thereby effectively reducing the mass of a potentially broken mandrel. Still other inventive concepts and embodiments of the present invention may be employed, as will be described in more detail hereinbelow.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which.

DESCRIPTION OF EMBODIMENTS OF THE INVENTION

Figure 1:
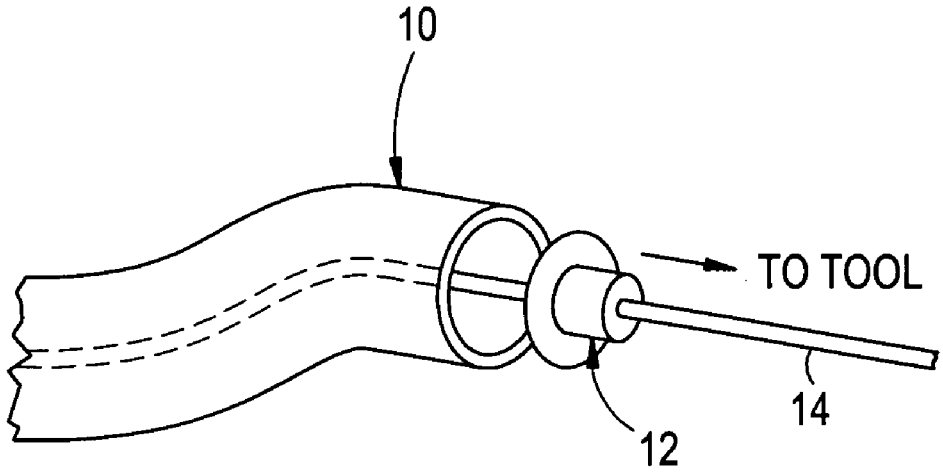
FIG. 1 illustrates a flexible tube which carries rivets to a tool along a guide wire.

While this invention may be susceptible to embodiment in different forms, there are shown in the drawings and will be described herein in detail, specific embodiments with the understanding that the present disclosure is to be considered an exemplification of the principles of the invention, and is not intended to limit the invention to that as illustrated.

FIG. 1 illustrates a first embodiment of the present invention wherein a flexible tube 10, such as a polypropylene tube, carries rivets 12 to a tool. Preferably, the rivets 12 are carried along a guide wire 14, such as a steel cable. The guide wire 14 may or may not be welded to a mandrel in the tool. If a guide wire is not used, the rivets must be longer than they are wide in order to prevent tumbling in the tube 10. Preferably, a guide wire 14 is employed and the rivets are blown through the tube using air.

Figure 2:
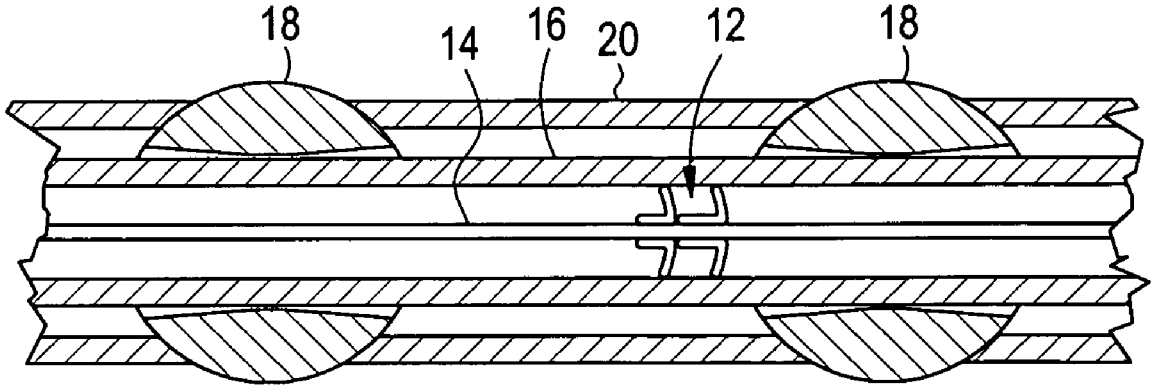
FIG. 2 illustrates a device which includes a flexible inner tube which carries rivets to a tool along a guide wire and an outer tube, wherein nylon balls are provided every inch or so along the outer tube and the nylon balls act as joints.

FIG. 2 illustrates a second embodiment of the present invention wherein a flexible, inner tube 16 (such as a polypropylene tube) carries rivets 12 along a guide wire 14 (such as a steel cable) to a tool, and nylon balls 18 are provided every inch or so along an outer tube 20 which may be made of aluminum. The nylon balls 18 work as joints, and allow the outer tube 20 to compress without shortening the center line. The outer tube 20 may be, for example, ten feet long and may be connected to a rivet tool.

Figure 3:
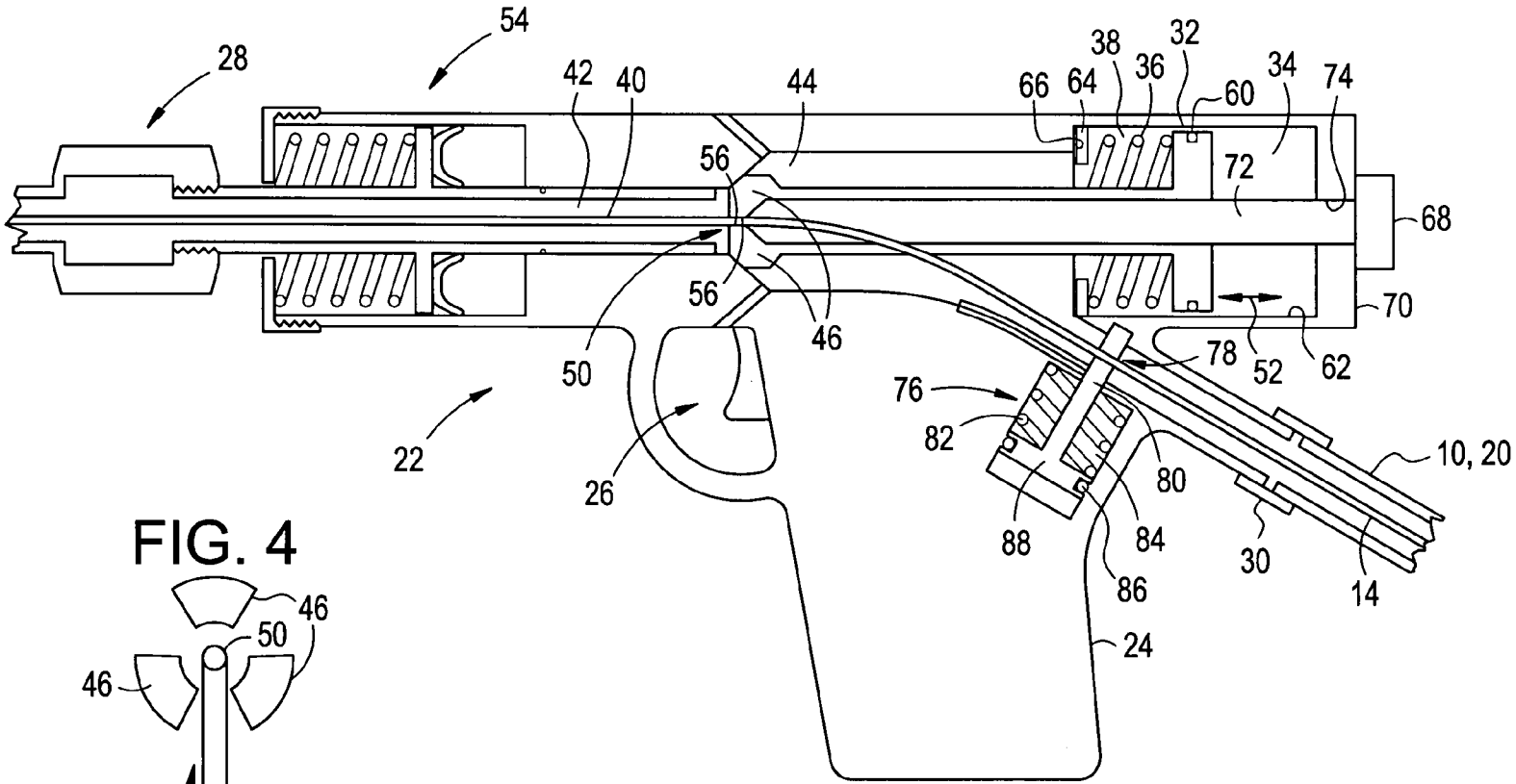
FIG. 3 illustrates a tool which can be used in association with either one of the devices shown in FIG. 1 or 2 (or with some other mechanism for delivering rivets to the tool)

FIG. 3 illustrates a tool 22 which can be used in association with either one of the devices shown in FIG. 1 or 2, or even in association with some other mechanism for delivering rivets to the tool. The tool 22 includes a handle 24, trigger 26 and nose piece 28 such as is described in GB 2124955, which is hereby incorporated herein by reference in its entirety. The tool 22 includes a coupling 30 which couples the tool to either one of the tubes 10 or 16 shown in FIG. 1 or 2 (or with some other mechanism for delivering rivets to the tool). The nose piece 28 is engaged with a plunger 32 which actuates by way of oil or air in one chamber 34, and is biased in the opposite direction by way of a spring 36 in another chamber 38.

Figure 4:
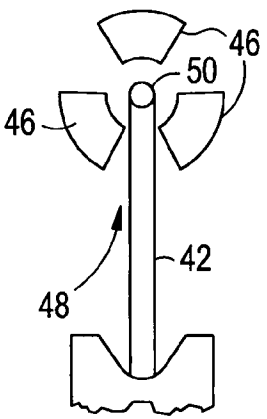
FIG. 4 illustrates how spoons of the tool of FIG. 3 center a guide cable.

As shown, a guide wire 14 (such as the guide wire from FIG. 1 or 2 or a guide wire from another mechanism) may be welded to a mandrel 40 in the tool 22 to form a guide cable 42 for the rivets. The guide cable 42 extends through a front portion 44 of the plunger 32 which preferably comprises a plurality of spoons 46. Specifically, as shown in FIG. 4, three spoons 46 may be provided, wherein the guide cable 42 extends through a space 48 between two of the spoons 46, and all three spoons 46 together define an opening 50 at their front ends for allowing the guide cable 42 to extend therethrough.

The spoons 46 are configured such that they can be retracted and advanced (as represented by arrow 52) such that they together operate as a plunger. In use, the spoons 46 can be retracted, a rivet fed along the guide cable 42 to a stack of rivets (not shown) on the mandrel 40 in the front portion 54 of the tool 22, and the spoons 46 advanced forward in the tool 22 to the position shown in FIG. 3, wherein they grip the mandrel 40. To provide an acceptable grip by the spoons 46, surface 56 of each of the spoons 46 may provide a serrated jaw. Alternatively, as described later hereinbelow, blades may be provided on the spoons 46 for gripping the mandrel 40. The spoons 46 advance by way of air or oil being provided to chamber 34 rearward of the spoons 46 in the tool 22, and retract by way of the air or oil being vented or removed from the chamber 34 and a spring force being applied to the spoons 46, via spring 36 which is provided in chamber 38. Preferably, a sealing member 60 is provided on a rear portion of the plunger mechanism 32, and the sealing member 60 seals against an inner wall 62 in the tool 22. Preferably, a retainer 64 is provided in the tool 22, against an inner shoulder 66 in the tool 22, and the spring 36 is disposed between the retainer 64 and the rear portion of the plunger mechanism 32. As shown, a rotational seal lock 68 may be provided at the rear 70 of the tool 22, where a front portion 72 extends into an opening 74.

The tool 22 may include a guide cable centering mechanism 76 for centering the guide cable 42. As shown, the guide cable centering mechanism 76 may comprise a blade 78 which engages a pin 80, and a spring 82 which is disposed in an opening 84 in the tool 22 and biases the pin 80. A sealing member 86 may be provided on a head portion 88 of the pin 80.

In use, the spoons 46 are retracted (i.e., by removing air or oil from chamber 34, thereby allowing the spring 36 to push the spoons 46 back). Then, a rivet is shot up the tube 10, 20, into the tool 22, to a chain of rivets sitting on the mandrel 42 in the front part 54 of the tool. Then, the spoons 46 are advanced (i.e., by forcing air or oil into chamber 34) to abut against the last rivet in the chain causing the first rivet in the chain to kick the nose 28 of the tool 22 open and advance out of the tool 22. Thereafter, the nose 28 closes and the tool 22 is actuated by actuating the plunger 32. Specifically, oil or air is forced into chamber 34 causing the plunger 32 to move forward while the mandrel 42 is held in place by the spoons 46. As discussed above, to provide an acceptable grip by the spoons 46, the spoons 46 may include serrated jaws. This advancement of the plunger 32 causes the frontmost rivet to broach. Thereafter, the spoons 46 can be retracted, another rivet shot through the tube 10, 20, and the spoons 46 advanced again. Providing that the spoons 46 are three in number provides that the spoons 46 are slidable away from the guide wire 42, and that the guide wire 42 can be maintained in position while the spoons 46 are retracted and advanced like a plunger.

Figure 5:
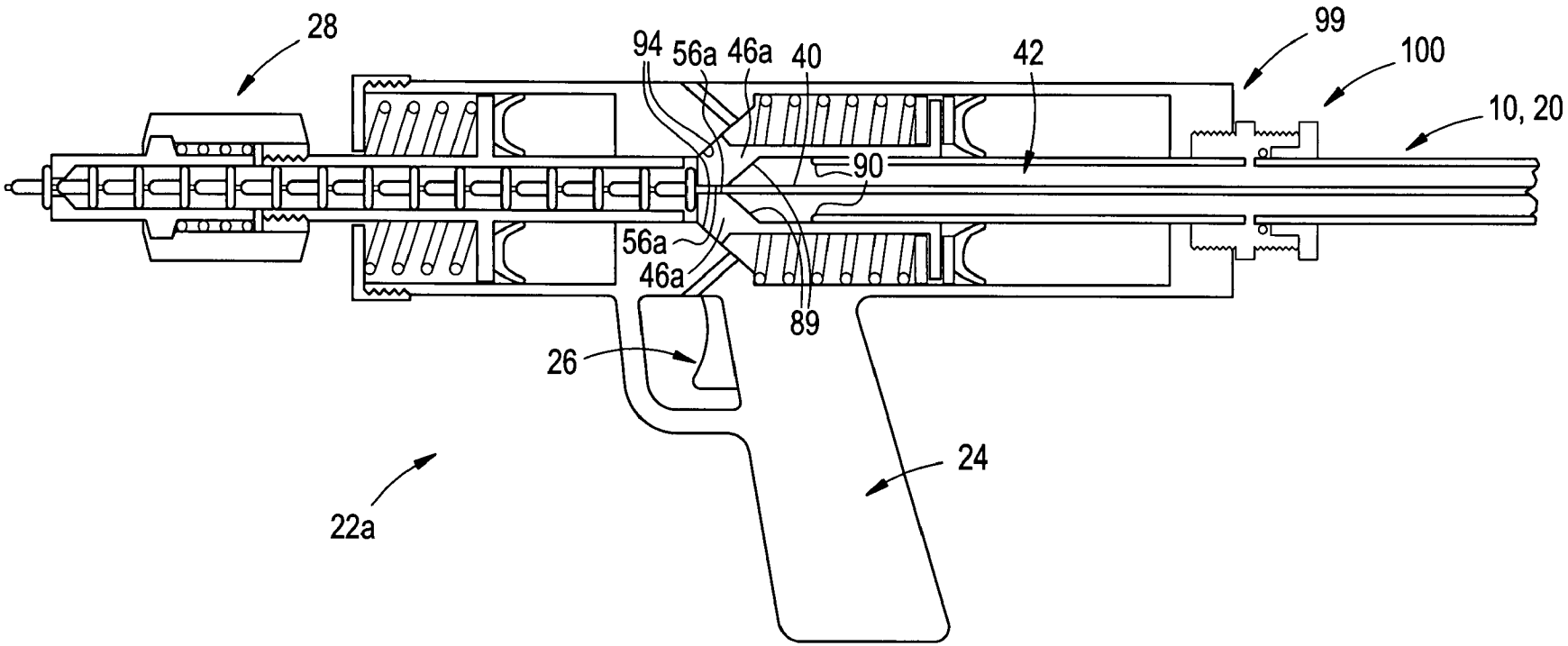
FIG. 5 illustrates another tool, where the tool is similar to the tool shown in FIG. 3 and can be used in association with either one of the devices shown in FIG. 1 or 2 (or with some other mechanism for delivering rivets to the tool)
Figure 6:
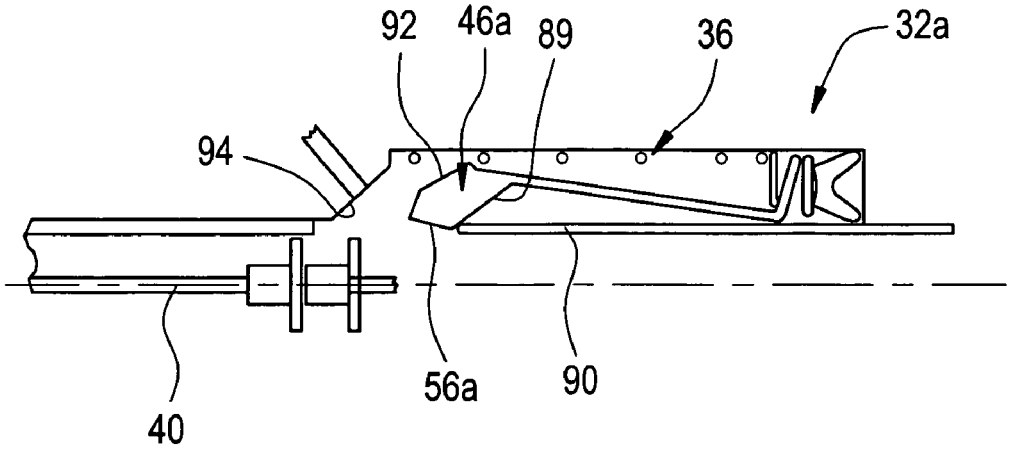
FIG. 6 illustrates opening of spoons of the tool shown in FIG. 5.

The tool 22*a* shown in FIG. 5 is very much like the tool 22 shown in FIG. 3 in that the tool includes a handle 24, a trigger 26, a nose 28, a plunger mechanism 32*a*, a spring 36 and spoons 46*a*. However, the spoons 46*a* of the tool 22*a* shown in FIG. 5 are two in number, and are configured such that they open when they retract (see FIG. 6) and close when they are fully advanced (see FIG. 5). In use, the spoons 46*a* are retracted (and opened) and a rivet is advanced (preferably through a tube 10, 20, along a guide wire 42, using air or oil) (see FIGS. 1 and 2). As shown in FIG. 6, when the spoons 46*a* retract, a surface 89 of the spoons 46*a* contacts an inner wall 90, and this causes the spoons 46*a* to rotate open. When the spoons 46*a* advance, a surface 92 of the spoons 46*a* contacts an inner shoulder 94, and this causes the spoons to rotate closed and grip the mandrel 40 when the spoons are fully advanced as shown in FIG. 5. The spoons 46*a* in the tool 22*a* shown in FIG. 5 serve the same three functions as the spoons 46 in the tool 22 shown in FIG. 3 (i.e., they allow the passage of a single rivet to a chain of rivets upstream from the spoons, thereafter grip the mandrel arresting the broaching load of the front-most rivet in the chain, and apply a force to the back-most rivet in the chain so the second rivet in the chain pushes the nose of the tool open to position the second rivet in the chain outside the tool for subsequent broaching). To provide an acceptable grip by the spoons, the spoons may provide serrated jaws at surface 56*a*. Alternatively, blades may be provided on the spoons.

The tool 22*a* shown in FIG. 5 is also different from the tool 22 shown in FIG. 3 in that the tool 22*a* is configured such that the tube 10, 20 for delivering rivets to the tool is connected to the rear end 99 of the tool 22*a*.

Figure 7:
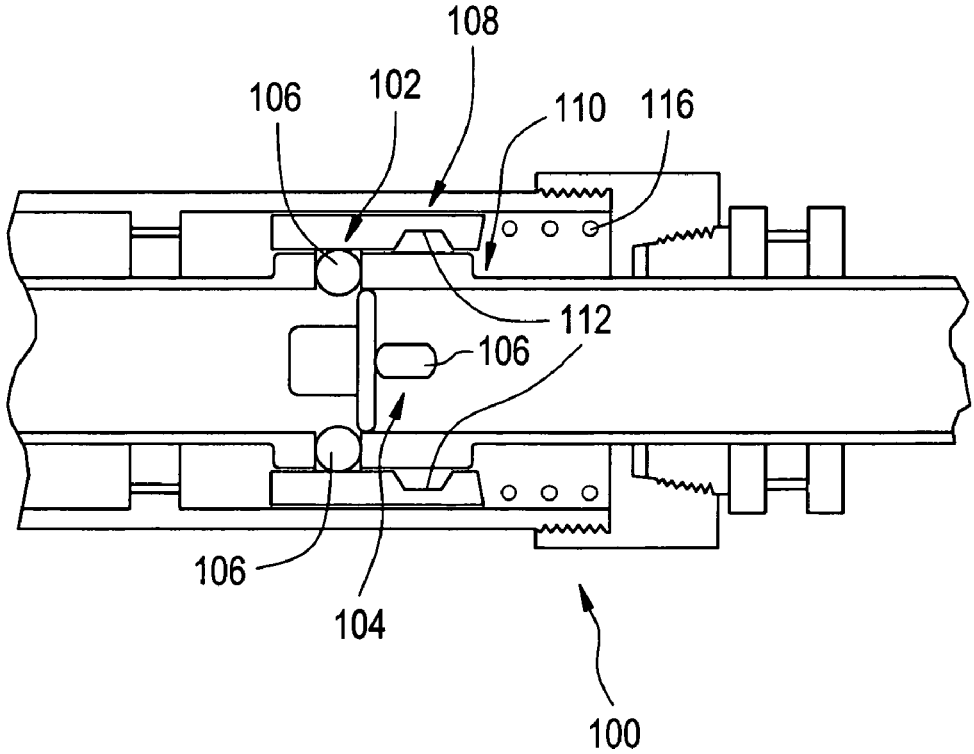
FIG. 7 illustrates a gate mechanism which can be employed in association with the tool shown in FIG. 5 (or with some other tool)

As shown in FIG. 5, a gate mechanism 100 may be provided proximate the rear 99 of the tool 22*a*. Specifically, as shown in FIG. 7, staggered pairs (i.e., pair 102 and pair 104) of balls 106 and a slidable collar 108 can be used to provide a gate 100. Such a gate 100 may be employed if it is desired to store rivets upstream from the tool 22*a*. Storing the rivets in this way can decrease cycle time. The gate 100 preferably provides that only one rivet a time is allowed to advance past the spoons 46*a* in the tool. If rivets are to be blown through the tube 10, 20 one at a time, preferably a gate is not used. Preferably, the gate 100 provides that one pair 104 of balls 106 is situated at 3 and 9 o'clock and, a little downstream, another pair 102 of balls 106 is situated at 12 and 6 o'clock. Preferably, the balls are contained in an internal shaft-like member 110 which has four holes 112—one for each ball 106, and the tool 22*a* includes one or more internal vents between the area in back of the spoons 46*a* in which air is supplied to advance the spoons 46*a* and another area (proximate the balls 106) which controls advancement and retraction of collar 108. Specifically, when air is supplied to advance the spoons 46*a*, the air vents to another area such that the collar 108 retracts (relative to direction of travel of the rivet). Likewise, when air is withdrawn to retract the spoons 46*a* (as a result of spring action), air withdraws from the other area as well, causing the collar 108 to advance (relative to direction of travel of the rivet) (also as a result of spring action). When the collar 108 is urged by spring 118 (i.e. forward), the downstream 104, 12 and 6 o'clock balls 106 drop into a recess 112 in the collar 108 while the other two balls 106 are pushed in, holding a rivet back. When the collar 108 is urged rearward by the air, the upstream 102, 3 and 9 o'clock balls 106 drop into the recess 112 in the collar 108 releasing the rivet to the other two balls (i.e., pair 104) which are now pushed in. When air is withdrawn and the collar 108 is thereafter urged forward by the spring 116, the downstream 102, 12 and 6 o'clock balls 106 again drop into the recess 112 in the collar 108 releasing the rivet so that the rivet can move past the spoons 46*a* (which are retracted and opened) to the chain of rivets in the front part of the tool 22*a* while the other two balls (i.e., pair 104) are pushed in, holding a new rivet back.

Figure 8:
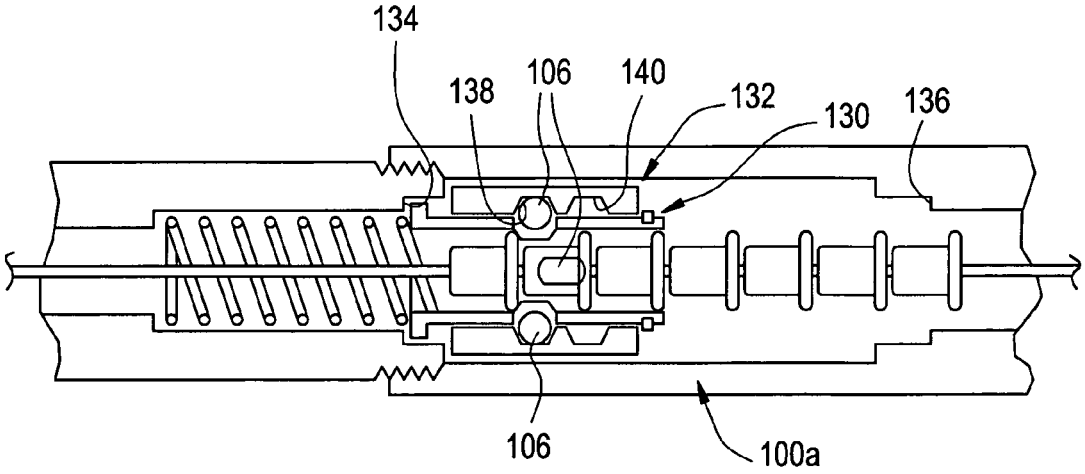
FIGS. 8 and 9 illustrate a gate mechanism which is similar to the gate mechanism shown in FIG. 7.
Figure 9:
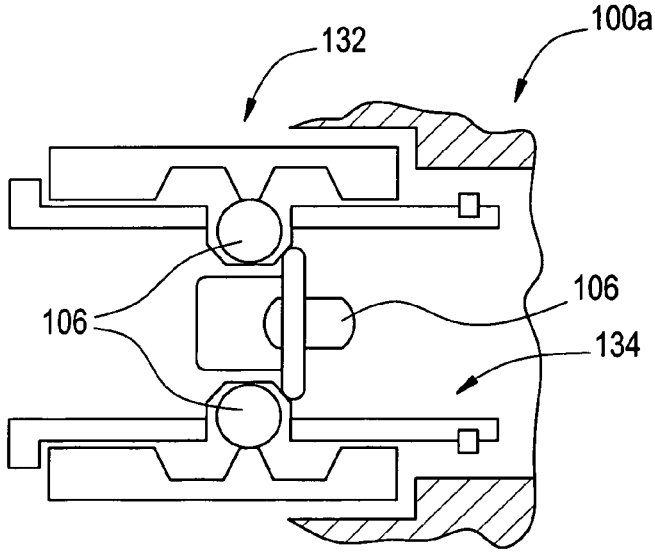

Another embodiment of such a gate 100*a* is shown in FIGS. 8 and 9 and may include two collars 130, 132 which each move in the tool and slide relative to each other. As the outer-most collar 132 hits certain surfaces 134, 136 upon advancement and retraction, the collars 130, 132 slide relative to each other causing one pair or the other of balls 106 to drop into one of two recesses 138, 140 which are provided in the outer-most collar 132. When the stack of rivets move left, as illustrated in FIGS. 8 and 9, collar 132 bottoms on collar 134, the balls 106 drop into recesses 138, causing one rivet to be released.

Figure 10:
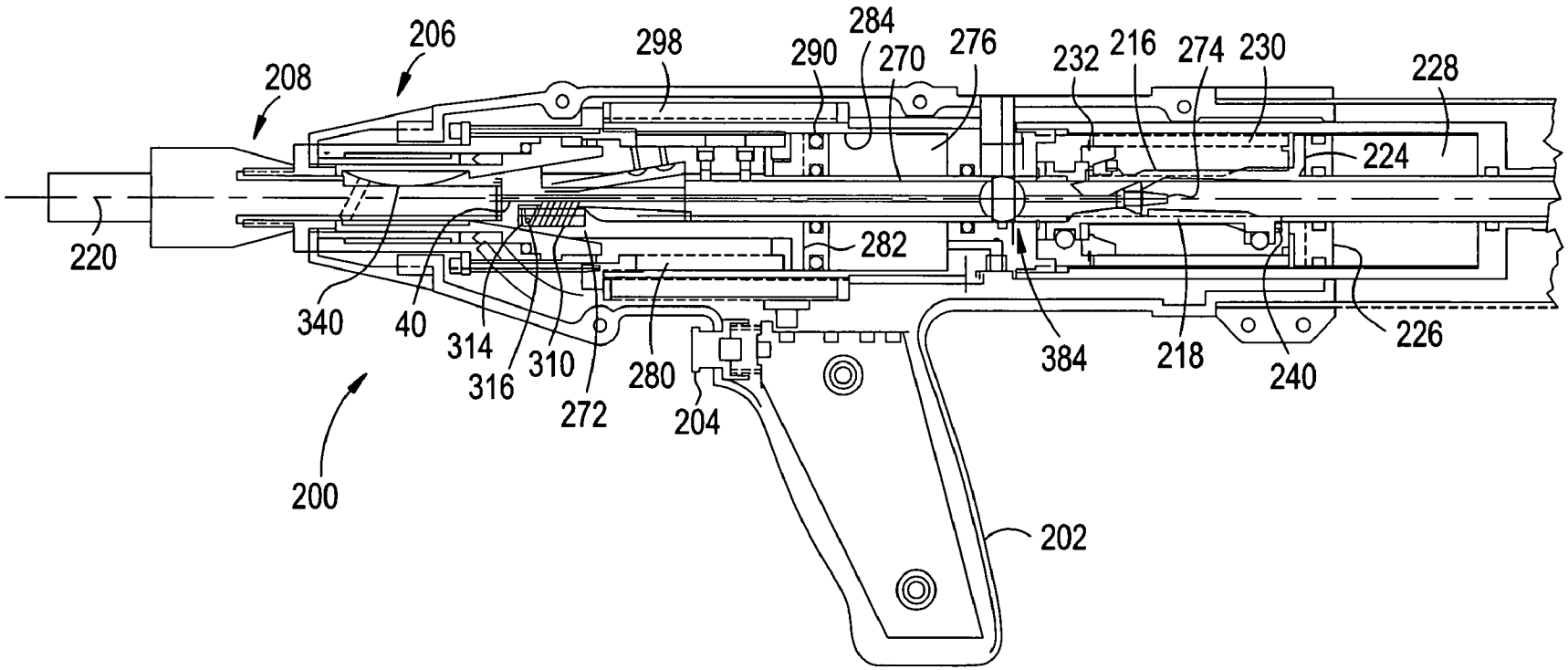
FIG. 10 illustrates a tool which is in accordance with an embodiment of the present invention.

FIG. 10 illustrates a tool 200 which is in accordance with a preferred embodiment of the present invention. The tool incorporates a plurality of inventive concepts, several of which will be described below.

Figure 11:
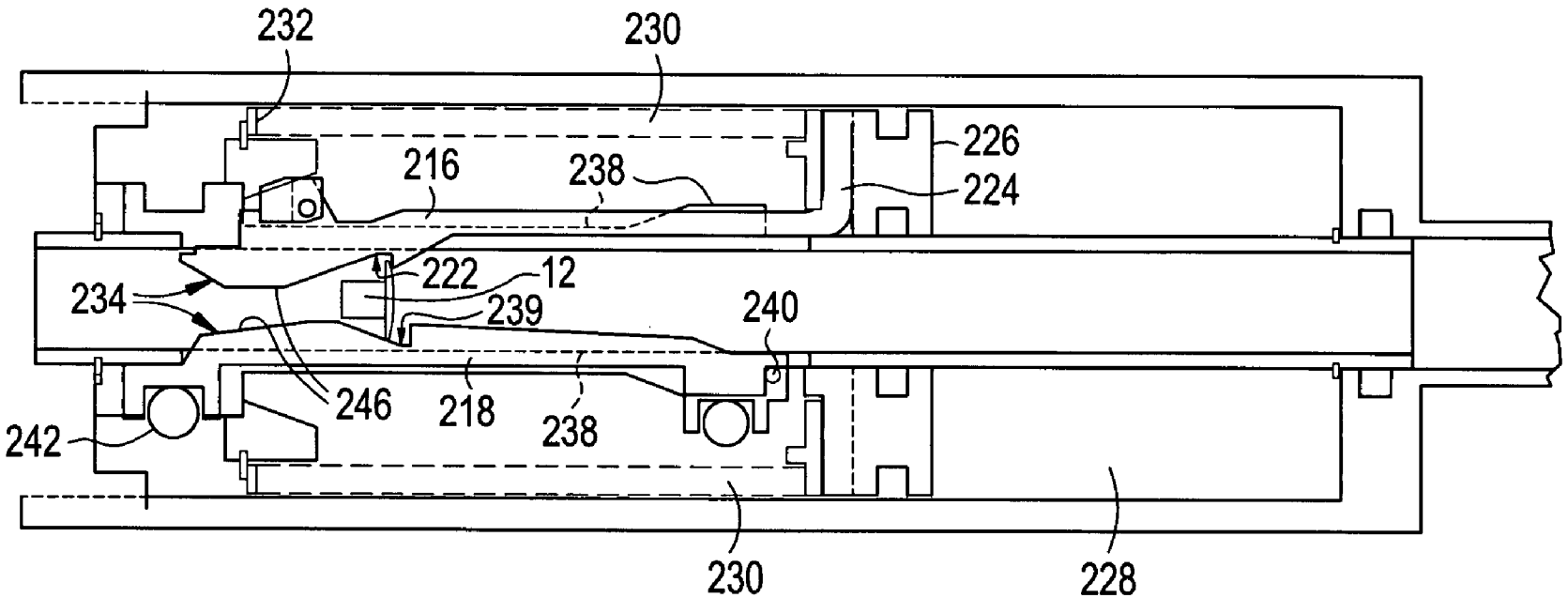
FIG. 11 illustrates a transfer mechanism which is incorporated in the tool shown in FIG. 10.
Figure 12:
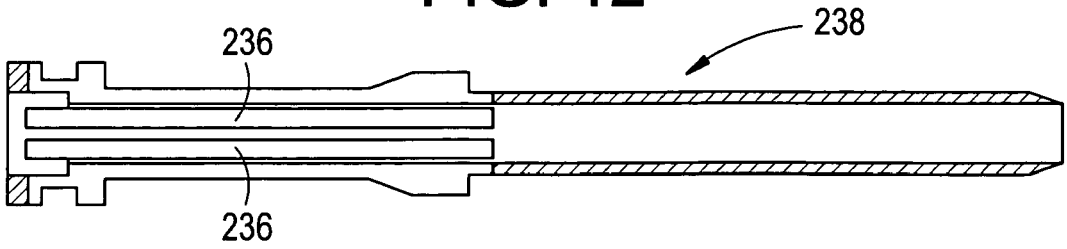
FIGS. 12–23 relate to the transfer mechanism shown in FIG. 11.
Figure 13:
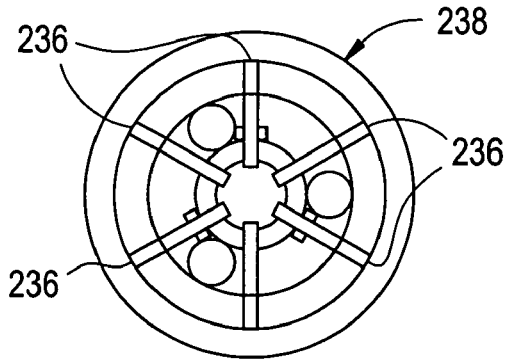

Much like other conventional tools, the tool includes a handle portion 202, a trigger 204, and an end piece 206 which is connected to a nose piece 208*a*. The nose piece 208*a* may be as is described in GB 2124955, which has been incorporated herein by reference (except for a preferred modification which will be described later herein). The tool 200 is connected to a rivet delivery tube 10, 20, such as shown in FIGS. 1 and 2. A mandrel 40 is disposed in the tool, spaced away from the end of a guide wire 14 disposed in the rivet delivery tube 10, 20. One of the inventive concepts which is incorporated in the tool shown in FIG. 10 is a transfer mechanism 212. The transfer mechanism 212 operates to transfer the rivets 12, one by one, from the guide wire 14 to the mandrel 40, and is preferably comprised of a plurality of blades 216, 218. Specifically, six spring loaded blades 214 may be provided—three of which are configured like the top blade 216 shown in FIG. 11, and three of which are configured like the bottom blade 218 shown in FIG. 11, alternating about a circle around the longitudinal axis 220 of the tool (i.e., a blade such as the top blade 216 shown in FIG. 11 is provided at 12 o'clock, 4 o'clock and 8 o'clock about the longitudinal axis 220 of the tool 200; and a blade such as the bottom blade 218 shown in FIG. 11 is provided at 2 o'clock, 6 o'clock and 10 o'clock about the longitudinal axis 220 of the tool 200).

The three blades 216 which are moveable longitudinally (i.e., the blades at 12 o'clock, 4 o'clock and 8 o'clock) include a stripper pocket 222 and have a rear portion 224 keyed to a plunger 226. Rearward of the plunger 226 is an air chamber 228 in which air is provided to advance the plunger 226 (and the three blades 216). The plunger 228 is biased rearward by a return spring 230 which is disposed between the plunger 228 and a retainer member 232 in the tool 200. Preferably, a front half portion 234 of each of the six blades extends in slots 236 provided in a cylindrical piece or tube 238 which is provided in the tool 200. While all the blades are configured to pivot radially outward, only every other blade is configured to translate along a longitudinal axis 220 of the tool 200. Hence, the transfer mechanism 212 preferably includes a set of three radially and longitudinally moving blades 216 and a set of three blades 218 which are longitudinally stationary but are moveable radially, and all six blades are received in slots 236 in the front portion of tube 238. With regard to the stationary blades 218, the blades include a stripper pocket 239, pins 240 stop them from moving substantially inward, and garter springs 242 stop them from moving longitudinally. The moving blades 216 retract and receive (and de-bounce) a rivet 12 from the guide wire 14, and then advance to transfer the rivet 12 to the mandrel 40. The stationary blades 218 remain forward holding the preceding rivet. Preferably, a front part 234 of the blades 216, 218 provides ramps 246 which tends to center the mandrel 40, such as when a new mandrel is being installed through the nose 208 of the tool 200.

Figure 14:
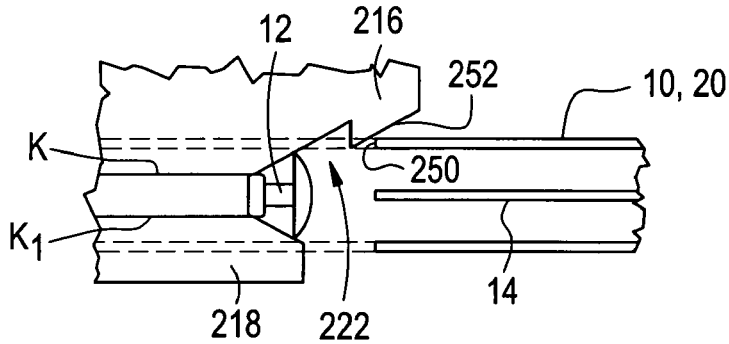
Figure 15:
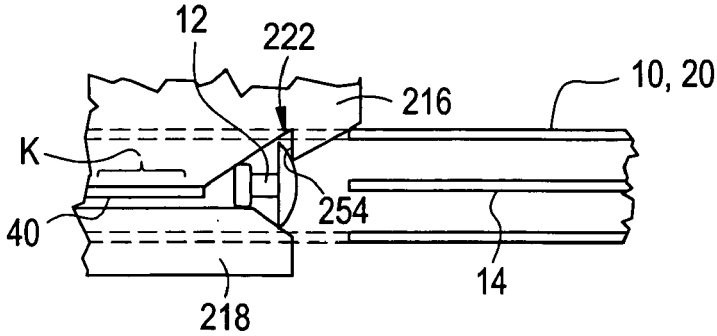
Figure 16:
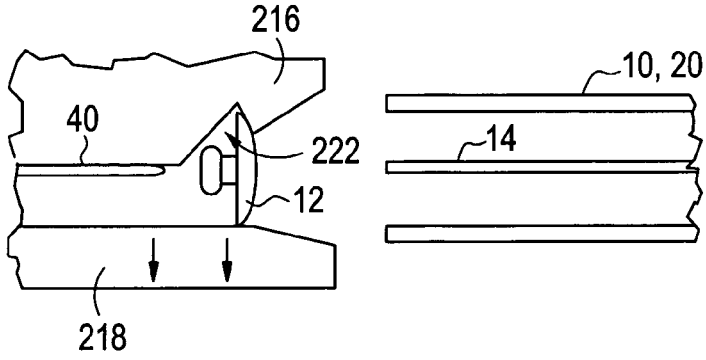
Figure 17:
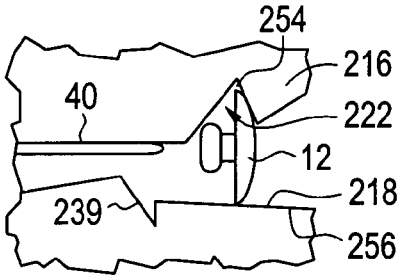
Figure 18:
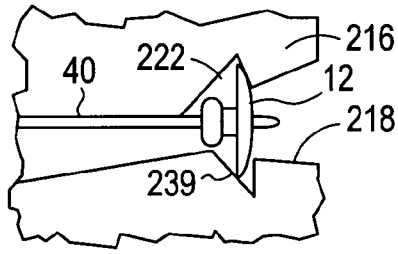
Figure 19:
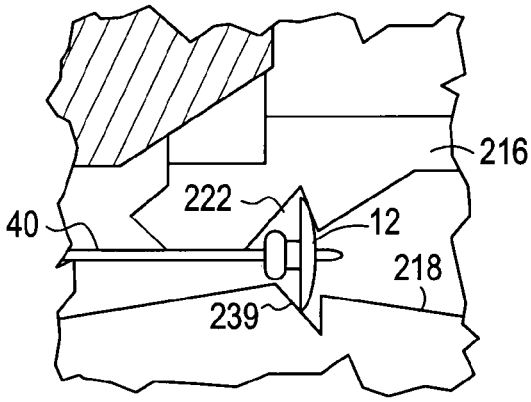
Figure 20:
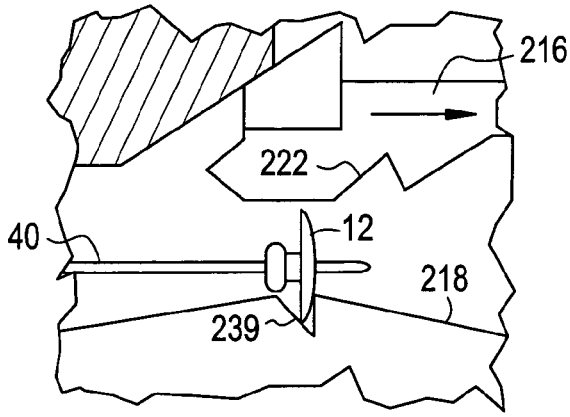
Figure 21:
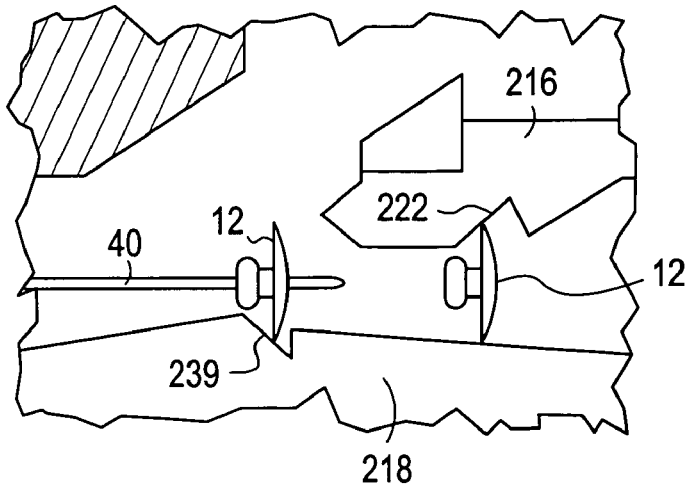
Figure 22:
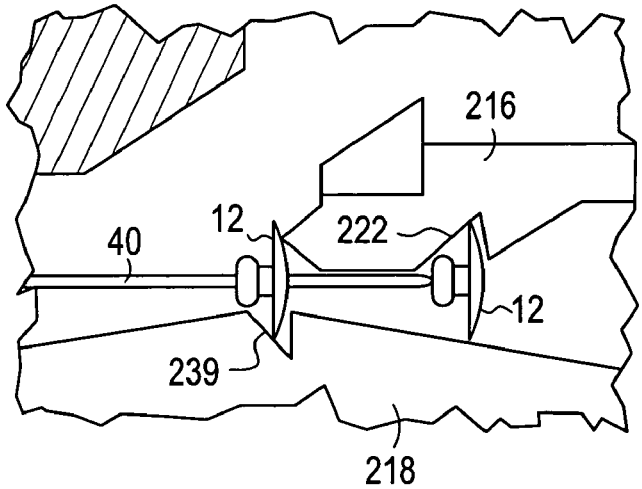
Figure 23:
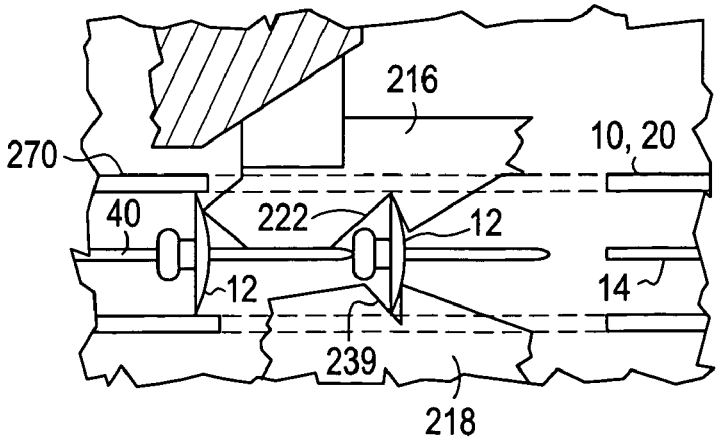
Figure 24:
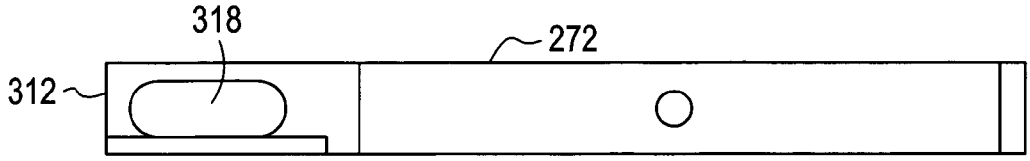
FIG. 24 illustrates a spoon which is incorporated in the tool shown in FIG. 10.

Operation of the transfer mechanism 212 will now be described with reference to FIGS. 14–23. Initially, as shown in FIG. 14, the three longitudinally moveable blades 216 are retracted, and contact of wall 250 of the tube 10, 20 and surface 252 of the blades 216 causes the blades 216 to pivot open (i.e., move radially outward). Then, a rivet 12 is delivered from the rivet delivery tube 10, 20. Then, as shown in FIG. 15, the three blades 216 are moved forward, causing surface 254 of the blades 216 to lock behind the rivet 12. Area "K" of the blades 216 also moves inward, thus centering the back end of the mandrel 40 between the blades and in line with the rivet 12. Then, as shown in FIG. 16, blades 216 move more forward, causing the other three blades 218 to move outward against spring pressure. As shown in FIG. 17, blades 218 preferably have a surface 256 which provides an 8 degree angle to insure (i.e., maintain) drag insuring that the head of the rivet 12 stays in true point contact with the surface 254 of blades 216 (otherwise, inward spring pressure can cause the rivet 12 to become mis-aligned). As shown in FIG. 18, blades 218 provide a stripper pocket 239, which works to string the rivet 12 on the mandrel 40 as the blades 216 are advanced further. As shown in FIG. 19, the rivet 12 continues slightly forward and is effectively converted into forward force on blades 216 into clamp force on the mandrel 40. As shown in FIG. 20, as blades 216 begin to retract (i.e., reset), the rivet 12 is caught in the stripper pocket 239. Then, as shown in FIG. 21, the blades 216 fully retract, and the next rivet 12 is received. As shown in FIG. 22, as the blades 216 are advanced, they push the previous rivet 12 out of the stripper pocket 239 and, as shown in FIG. 23, into the tube 270, and the air that is used to blow the rivets 12 into the tool propels the rivet 12 down the tube 270, along the mandrel 40, toward the nose 208*a* of the tool 200. When a new mandrel 40 is to be inserted in the tool, the moveable blades 216 are placed in the retracted position.

Another inventive concept which is incorporated in the tool 200 shown in FIG. 10 is the use of spoons 272 which grip the mandrel 40, preferably away from a back end 274 of the mandrel 40. Preferably, the tool 200 is designed to use a standard 19 inch mandrel. The spoons 272 open and close as well as retract and advance. Specifically, the spoons 272 open when they are fully retracted and close when they are fully advanced in the tool 200 (i.e., toward the nose 208 of the tool 200). When the spoons 272 close, they grip a mandrel 40, preferably a distance from the rear end 274 of the mandrel 40. The spoons 272 advance by way of air being provided to a chamber 276 rearward of the spoons 272 in the tool 200, and retract by way of air being vented from the chamber 276 and a spring force being applied to a rear portion 278 of the spoons 272, via a spring 280 which is provided in a chamber 276 proximate the rear portion 278 of the spoons 272.

Figure 27:
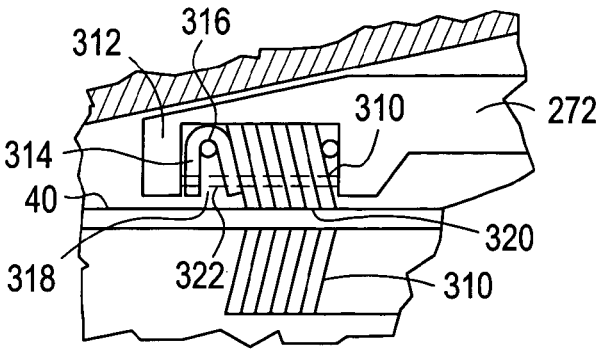
FIG. 27 illustrates functioning of blades which are included on the spoons, as the spoons grip a mandrel.
Figure 29:
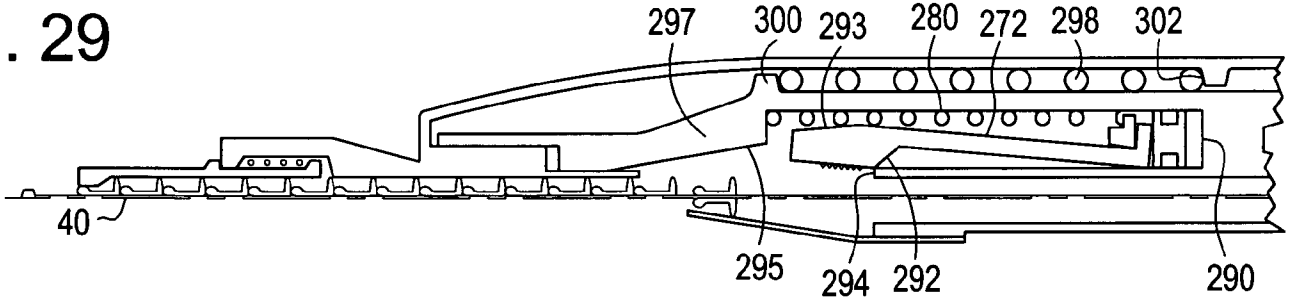
FIGS. 29–31 illustrate advancement and retraction of spoons and gripping of the mandrel.
Figure 30:
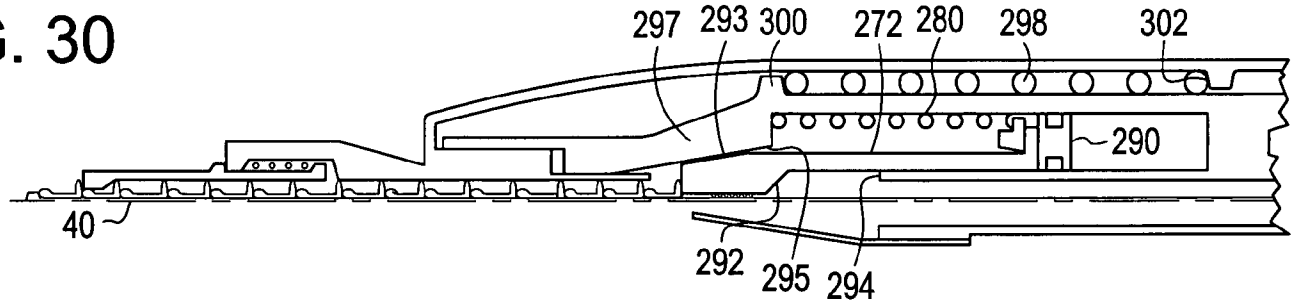
Figure 31:
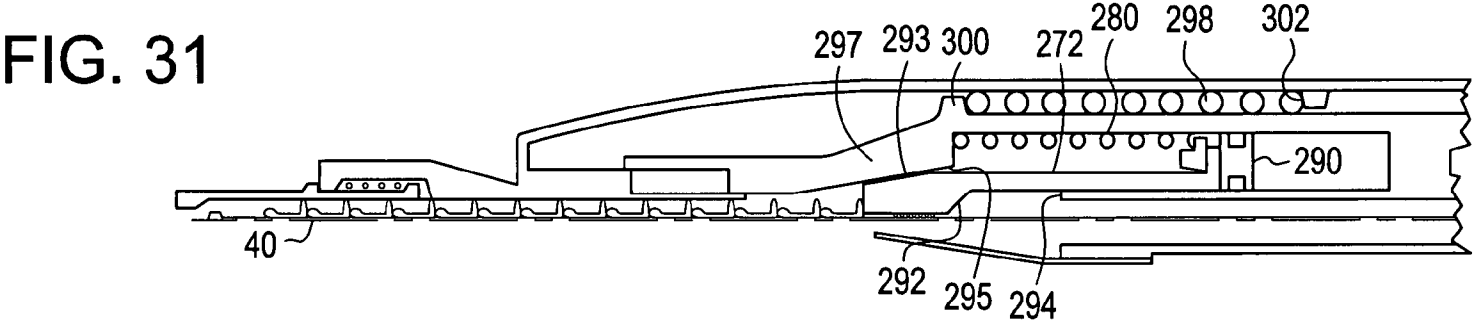
Figure 32:
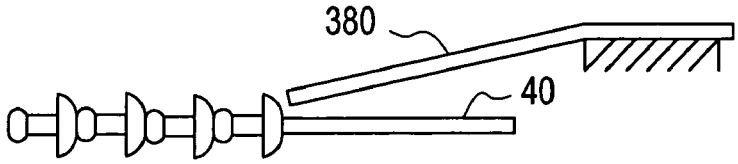
FIGS. 32–35 illustrate a mechanism in the front of the tool which prevents an empty mandrel from exiting the tool.

The spoons 272 are attached to a plunger mechanism 290, and the spoons 272 are configured to operate much the same way as the spoons which are provided in the tool shown in FIG. 5 in that when the spoons 272 retract, ramps 292 on the spoons 272 contact an inner wall 294 (see FIG. 29) in the tool 200, causing the spoons 272 to open. As shown in FIGS. 27, 30 and 31, when the spoons 272 advance, ramps 293 on the spoons 272 contact an inner wall 295 on an inner sleeve 297 in the tool 200, causing the spoons 272 to pivot closed, thereby gripping the mandrel 40. A spring 298 is provided in the tool 200, disposed between an external shoulder 300 on the inner sleeve 297 and an internal shoulder 302 in the tool 200. The spring 298 works to bias the inner sleeve 297 forward in the tool 200.

Figure 25:
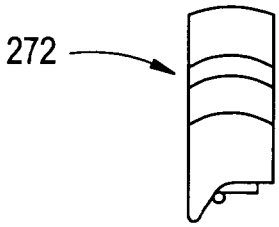
FIGS. 25 and 26 illustrate end profiles of the spoons incorporated in the tool shown in FIG. 10.
Figure 26:
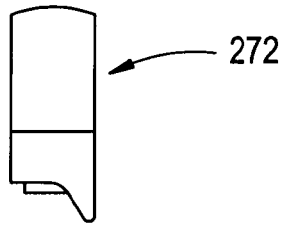
Figure 28:
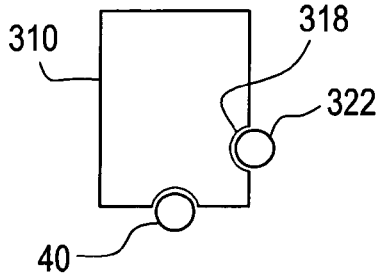
FIG. 28 illustrates a preferred shape of the blades.

Blades 310 are provided proximate the front end 312 of the spoons 272 to facilitate an effective grip on the mandrel 40—a grip which is strong, but does not tend to fray the mandrel 40, thereby prolonging the life of the mandrel 40. As shown in FIGS. 10 and 27, a spring 314 is provided in a recess 318 in the spoons 272, and a pin 316 holds the spring 314 in place. The spring 314 biases an outside edge 320 of the blades 310 toward the rear of the tool 200, but provides that the outside edge 320 of the blades 310 can pivot or cant generally toward the nose 208 of the tool 200. The canting increases the pinch force significantly because the canting requires little force and has very little friction. The blades 310 are held in position in the recess 318 in the spoons 272 by pins 322. Preferably, the blades 310 are shaped as shown in FIG. 28, and include a hole 324 for receiving pin 322, and include a notch 326 for receiving the mandrel. Preferably, the spoons 272 have end profiles which correspond to each other as shown in FIGS. 25 and 26, where FIG. 25 illustrates the end profile of the top spoon and FIG. 26 illustrates the end profile of the bottom spoon. The end profiles of the spoons facilitate centering of the mandrel 40 in the tool 200 as the mandrel is gripped by the spoons.

To increase the life of the mandrel, the tool is designed such that the mandrel is not gripped at its end and then pulled, but is gripped very much forward of the end of the mandrel. Plus, the jaws of the spoons are not serrated, but instead include a plurality of pivotable spring-biased blades 310 which are contained in a recess 318 in each of the spoons 272. The blades engage the mandrel and as the mandrel tries to shift forward as the front-most rivet is being broached, the blades shift, as opposed to serrated edges tending to cut into the mandrel as the mandrel tries to shift. The blades 310 allow the mandrel to play a little, and as the blades 310 pivot, they tighten their grip on the mandrel 40. This results in less of a likelihood that the mandrel gets frayed. This is important as fraying of the mandrel decreases the life of the mandrel, and rivets tend to get hung up at the frayed area of the mandrel.

As shown in FIG. 10, a leaf spring 340 may be provided near the nose 208*a* of the tool 200, where the leaf spring 340 tends to center the mandrel 40 in the tool 200. While a leaf spring 340 is shown in FIG. 10, the leaf spring 340 can be omitted. The tool 200 is designed such that signals are transmitted to indicate the position of a rivet in the tool. This information is used to determine when to send air/oil to the tool. The leaf spring 340 near the spoons 272 provides a metal contact sensor for indicating when a rivet has advanced past where the jaws of the spoons 272 are to grip the mandrel. This is important in order to avoid the tool becoming jammed by gripping a rivet instead of the mandrel. The contact sensor signals the arrival of a new rivet, and gives the clear signal for the spoons to close, insuring that they do not close on the rivet.

Figure 33:
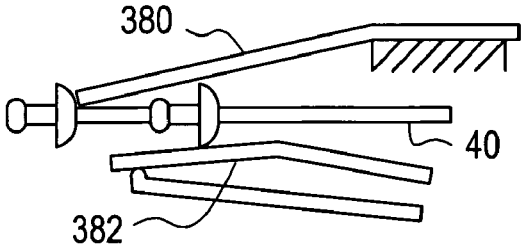

As shown in FIG. 33, there is preferably a check valve 380 spring 180 degrees from a contact spring 382. The check valve spring manages the stack of rivets in the front part of the tool and prevents them from sliding back. In order to provide that the tool can be a reasonable length, the spring which provides a force that counters the oil which is used to broach the rivet is located near the middle of the tool.

The tool includes one or more centering mechanisms which work to center the mandrel and center a new mandrel as it is being installed. It is important to center the mandrel so that it has no problem in receiving a new rivet as it is being transported from the guide wire to the mandrel. One centering mechanism which may be incorporated in the tool may consist of two buttons 384 accessible from outside the tool 200 which work to effect the opening of an aperture which, when closes, tends to center the mandrel. When a new mandrel is installed, the buttons 384 are pushed until the mandrel is advanced past the aperture. Then, the buttons are released and the aperture closes, thereby centering the mandrel. As discussed above, preferably the transfer mechanism 210 also provides a mandrel centering function in that the transfer mechanism includes blades 216, 218 which have ramps that work to center the mandrel.

Figure 34:
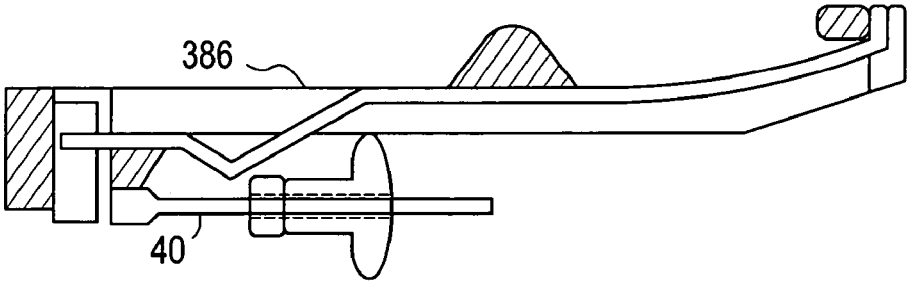
Figure 35:
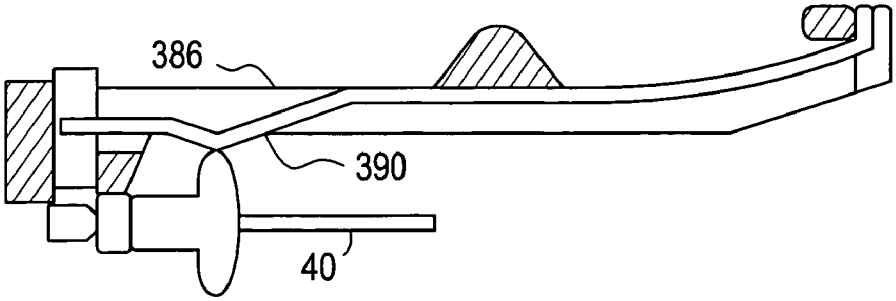

As shown in FIGS. 34 and 35, a spring/cam operated stopper 386 may be provided proximate the nose 208*a* to prevent an empty mandrel from traveling out of the tool 200.

Only when the rivet is pushed up and sits against the bulb 390 will the rivet lift the stop allowing the mandrel with the rivet through the nose.

Figure 36:
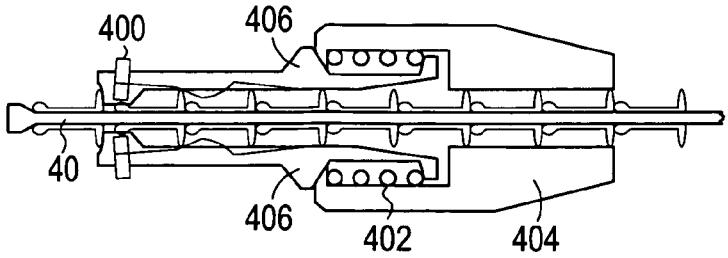
FIGS. 36–40 provide a sequence of views which illustrates operation of the nose of the tool during broaching of a rivet.
Figure 37:
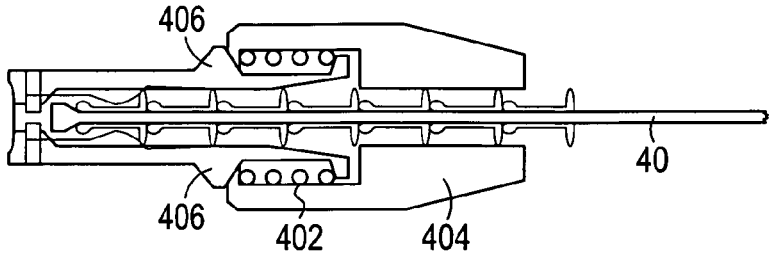
Figure 38:
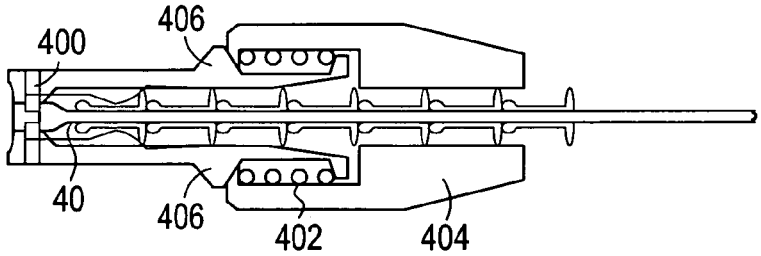
Figure 39:
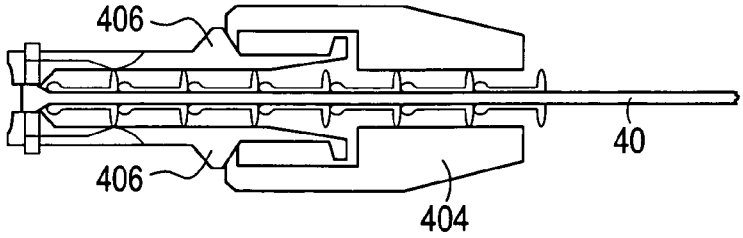
Figure 40:
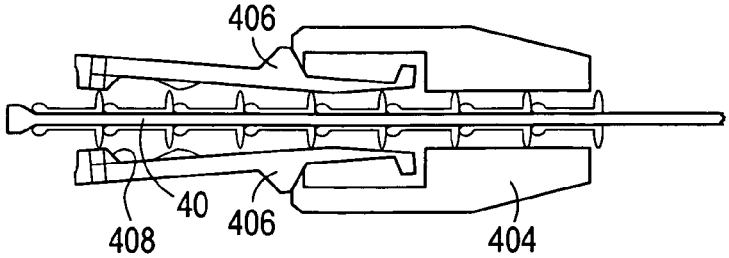

The nose piece 208*a* may be as is described in GB 2124955, which has been incorporated herein by reference, except the nose piece 208*a* preferably includes nose pins 400 proximate an end of the nose piece. Operation of the nose piece during actuation of the tool is shown in the progression from FIG. 36 through FIG. 40. As shown, a spring 402 is provided between part 404 and nose halves 406 to provide a biasing effect (for clarity, the spring is omitted from FIGS. 39 and 40). FIG. 36 shows the nose ready to broach a rivet. Nose pins 400 are pushed out by the rivet stem. FIG. 37 shows the nose after the rivet has been broached. The nose pins 400 are biased in, due to the leaf spring cam. FIG. 38 shows forward movement of the mandrel being arrested by the nose pins 400. FIG. 39 shows the stack of rivets being pushed forward (by forward motion of the spoons 272) (see FIGS. 29 and 31) and the lead rivet flange is operating the leaf spring cam, thus opening the nose pins 400 allowing the mandrel tip to pass. FIG. 40 shows how the rivet flange contacts an inside wall 408 of the nose halves 406, thus opening the nose to pass the rivet. The nose pins 400 are configured such that when they are extended (i.e., in) they do not effect (i.e., restrict) operation due to interference with the head of a rivet when the nose is open.

While embodiments of the invention are shown and described, it is envisioned that those skilled in the art may devise various modifications without departing from the spirit and scope of the foregoing description.

What is claimed is:

1. A method of providing rivets to a tool, said method comprising: provid ng a flexible tube having a guide wire disposed therein; connecting the flexible tube to the tool; and blowing rivets along the guide wire, through the flexible tube, to the tool.

2. A method as recited in claim 1, wherein the tool includes a mandrel, said method further comprising connecting the guide wire to the mandrel, and blowing rivets along the guide wire to the mandrel.

3. A method as recited in claim 1, wherein the step of providing a flexible tube having a guide wire disposed therein comprises providing an inner tube disposed in an outer tube, said inner tube having said guide wire disposed therein, wherein the step of blowing rivets along the guide wire, through the flexible tube, to the tool comprises blowing rivets along the guide wire, through the inner tube, to the tool.

4. A method as recited in claim 3, wherein the step of providing an inner tube disposed in an outer tube comprises providing that the outer tube includes balls which work as joints.

5. A device for providing rivets to a tool, said device comprising: a flexible tube having a guide wire disposed therein, wherein an end of said flexible tube is engageable with the tool, said flexible tube configured such that said rivets are blowable along the guide wire, through the flexible tube, to the tool.

6. A device as recited in claim 5, further comprising an inner tube disposed in an outer tube, said inner tube having said guide wire disposed therein.

7. A device as recited in claim 6, wherein the outer tube includes balls which work as joints.

8. A tool for pulling a mandrel through a rivet to effect installation of the rivet, said tool comprising: a body; a plunger in the body, said plunger comprising spoons at one end, wherein the mandrel is positioned between the spoons, said plunger moveable back in the body thereby allowing a rivet to be provided between the spoons to the mandrel, said plunger moveable forward in the body such that the spoons grip the mandrel as the tool broaches a rivet outside the tool.

9. A tool as recited in claim 8, wherein each spoon includes at least one of a serrated jaw and blades for facilitating gripping of the mandrel.

10. A tool as recited in claim 8, further comprising a pin, and a spring which is disposed in an opening in the tool and which biases the pin.

11. A tool as recited in claim 8, further comprising two spoons which are configured to open when the plunger moves back in the body and are configured to close when the plunger moves forward in the body.

12. A tool as recited in claim 11, wherein each of said spoons includes a surface which contacts an inner wall of the tool when the plunger moves back in the body, thereby causing the spoons to rotate open.

13. A tool as recited in claim 11, wherein each of said spoons includes a surface which contacts an inner shoulder of the tool when the plunger moves forward in the body, thereby causing the spoons to rotate closed and grip the mandrel.

14. A tool as recited in claim 11, wherein each of said spoons includes a first surface which contacts an inner wall of the tool when the plunger moves back in the body, thereby causing the spoons to rotate open, and wherein each of said spoons includes a second surface which contacts an inner shoulder of the tool when the plunger moves forward in the body, thereby causing the spoons to rotate closed and grip the mandrel.

15. A tool as recited in claim 8, wherein an end of the tool is configured to receive a flexible tube having a guide wire therein for providing rivets to the tool.

16. A tool as recited in claim 8, further comprising a gate mechanism proximate an end of the tool, and wherein the tool is configured such that only one rivet at a time is allowed to advance past the spoons.

17. A tool as recited in claim 16, wherein said gate mechanism comprises a plurality of balls which engage a slidable collar.

18. A tool as recited in claim 17, wherein said gate mechanism further comprises an internal member which includes a hole for each ball.

19. A tool as recited in claim 17, wherein the collar is spring-biased in the body.

20. A tool as recited in claim 18, wherein said gate mechanism further comprises a first pair of balls and a second pair of balls, wherein the collar is slidable relative to the internal member such that in one position, the first pair of balls drop into recesses in the collar and the second pair of balls are pushed inward by the collar, and wherein the collar is slidable relative to the internal member such that in another position, the second pair of balls drop into recesses in the collar and the first pair of balls are pushed inward by the collar.

21. A tool as recited in claim 8, further comprising a transfer mechanism which comprises a plurality of blades for retaining and moving rivets in the body.

22. A tool as recited in claim 21, wherein the transfer mechanism comprises a first set of blades which are moveable in the body such that the first set of blades can advance and retract, and a second set of blades which are not moveable in the body such that the second set of blades cannot advance and retract.

23. A tool as recited in claim 22, wherein the first set of blades are configured to retract, receive a rivet and advance thereby advancing the rivet in the tool.

24. A tool as recited in claim 22, wherein the blades are arranged about a circle around a longitudinal axis of the tool.

25. A tool as recited in claim 22, wherein each of the blades is spring-loaded.

26. A tool as recited in claim 22, wherein the first set of blades is keyed to the plunger.

27. A tool as recited in claim 26, wherein each of the blades of the first set of blades includes a stripper pocket which is configured to string a rivet on the mandrel in the tool.

28. A tool as recited in claim 22, further comprising a cylindrical tube disposed in the body, wherein a front portion of each of the blades extends in slots which are provided in the cylindrical tube.

29. A tool as recited in claim 22, wherein each blade is configured to pivot outwardly.

30. A tool as recited in claim 22, further comprising pins which engage the second set of blades thereby preventing the second set of blades from moving substantially inwardly, and further comprising garter springs which engage the second set of blades thereby preventing the second set of blades from moving longitudinally along a longitudinal axis of the tool.

31. A tool as recited in claim 8, wherein each spoon includes a recess having blades disposed therein, and a spring which biases the blades such that an outside edge of the blades is biased toward a rear end of the tool, and the blades can pivot generally toward a front end of the tool.

32. A tool as recited in claim 31, wherein each blade includes a notch which engages the mandrel.

33. A tool as recited in claim 8, further comprising a nose, and a leaf spring disposed in the nose and configured to center the mandrel.

34. A tool as recited in claim 33, wherein the leaf spring senses the presence of a rivet.

35. A tool as recited in claim 8, further comprising a contact spring, and a check valve spring which is opposite the contact spring, wherein the check valve spring, manages a stack of rivets and prevents said stack from sliding back and wherein the contact spring senses the presence of a rivet.

36. A tool as recited in claim 8, further comprising a plurality of buttons which are accessible from outside the tool for centering the mandrel in the tool.

* * * * *